US009229356B2

(12) United States Patent
Matsui

(10) Patent No.: US 9,229,356 B2
(45) Date of Patent: Jan. 5, 2016

(54) IMAGE FORMING APPARATUS EMPLOYING TOUCHDOWN DEVELOPING METHOD

(71) Applicant: KYOCERA Document Solutions Inc., Osaka-shi, Osaka (JP)

(72) Inventor: Kenshi Matsui, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/295,704

(22) Filed: Jun. 4, 2014

(65) Prior Publication Data

US 2014/0369705 A1 Dec. 18, 2014

(30) Foreign Application Priority Data

Jun. 12, 2013 (JP) ..... 2013-123560

(51) Int. Cl.
*G03G 15/06* (2006.01)
*G03G 15/02* (2006.01)

(52) U.S. Cl.
CPC ..... *G03G 15/065* (2013.01); *G03G 15/0266* (2013.01); *G03G 2215/0132* (2013.01)

(58) Field of Classification Search
CPC ..... G03G 15/065; G03G 15/0266
See application file for complete search history.

(56) References Cited

U.S. PATENT DOCUMENTS

| | | | | |
|---|---|---|---|---|
| 6,064,847 | A * | 5/2000 | Iwamatsu et al. | 399/283 |
| 2007/0292165 | A1* | 12/2007 | Hirayama et al. | 399/267 |
| 2008/0267641 | A1* | 10/2008 | Konishi et al. | 399/27 |
| 2010/0111551 | A1* | 5/2010 | Fujihara et al. | 399/55 |
| 2012/0020688 | A1* | 1/2012 | Yotsutsuji | 399/55 |
| 2012/0328313 | A1* | 12/2012 | Kamiyama | 399/55 |

FOREIGN PATENT DOCUMENTS

| | | | | |
|---|---|---|---|---|
| JP | 2005-078015 | * | 3/2005 | G03G 21/00 |
| JP | 2006-178066 | | 7/2006 | |

* cited by examiner

*Primary Examiner* — David Gray
*Assistant Examiner* — Thomas Giampaolo, II
(74) *Attorney, Agent, or Firm* — Gerald E. Hespos; Michael J. Porco; Matthew T. Hespos

(57) ABSTRACT

An image forming apparatus includes an image carrier, a developer carrier, a toner carrier, a bias voltage control unit, and a detection unit. The developer carrier carries a developer layer containing toner, an additive and carriers thereon. The toner carrier supplies toner to the image carrier. The bias voltage control unit changes bias voltage setting from ordinary developing mode to toner removing mode when the detection unit detects toner adhesion in excess of a threshold value on the toner carrier. In the toner removing mode, the bias voltage control unit sets the bias voltage to be applied to the image carrier, the developer carrier, and the toner carrier so that only the additive remains on the circumferential surface of the toner carrier, and the developer layer carried on the developer carrier contacts the circumferential surface of the toner carrier with a larger force, as compared with the ordinary developing mode.

6 Claims, 11 Drawing Sheets

FIG. 11

(EXAMPLE 1)

| NUMBER OF PRINTED SHEETS | 0 | 10000 | 30000 | 50000 | 70000 | 100000 |
|---|---|---|---|---|---|---|
| FOG | 0.001 | 0.002 | 0.002 | 0.001 | 0.002 | 0.002 |
| DENSITY | 1.42 | 1.43 | 1.45 | 1.39 | 1.42 | 1.42 |
| DEGREE OF ADHESION (VISUAL OBSERVATION) | ○ | ○ | ○ | ○ | ○ | ○ |

(EXAMPLE 2)

| NUMBER OF PRINTED SHEETS | 0 | 10000 | 30000 | 50000 | 70000 | 100000 |
|---|---|---|---|---|---|---|
| FOG | 0.001 | 0.003 | 0.001 | 0.002 | 0.002 | 0.001 |
| DENSITY | 1.43 | 1.42 | 1.38 | 1.39 | 1.42 | 1.45 |
| DEGREE OF ADHESION (VISUAL OBSERVATION) | ○ | ○ | ○ | ○ | ○ | ○ |

(COMPARATIVE EXAMPLE)

| NUMBER OF PRINTED SHEETS | 0 | 10000 | 30000 | 50000 | 70000 | 100000 |
|---|---|---|---|---|---|---|
| FOG | 0.001 | 0.003 | 0.005 | 0.011 | 0.018 | 0.029 |
| DENSITY | 1.43 | 1.42 | 1.38 | 1.29 | 1.18 | 1.08 |
| DEGREE OF ADHESION (VISUAL OBSERVATION) | ○ | ○ | ○ | × | × | × |

IMAGE FORMING APPARATUS EMPLOYING TOUCHDOWN DEVELOPING METHOD

This application is based on Japanese Patent Application No. 2013-123560 filed on Jun. 12, 2013, the contents of which are hereby incorporated by reference.

BACKGROUND

The present disclosure relates to an image forming apparatus provided with a developing device of a touchdown developing method, using a two-component developer containing toner and carriers.

An electrophotographic image forming apparatus such as a copying machine, a printer, and a facsimile machine is configured to form a toner image on an image carrier by supplying a developer onto an electrostatic latent image formed on the image carrier (e.g. a photosensitive drum or a transfer belt), and developing the electrostatic latent image. As one of the developing methods, there is known a touchdown developing method of using a two-component developer containing toner as a non-magnetic material and carriers as a magnetic material. In this method, a layer of a two-component developer (a magnetic brush layer) is carried on a magnetic roller, a toner layer is carried on a developing roller (a toner carrier) by receiving toner from the magnetic brush layer, and toner is supplied from the toner layer onto an image carrier, whereby the electrostatic latent image is developed.

SUMMARY

An image forming apparatus according to an aspect of the present disclosure includes an image carrier, a developer carrier, a toner carrier, a bias voltage control unit, and a detection unit.

The image carrier includes a circumferential surface configured to carry an electrostatic latent image and a toner image thereon. The developer carrier includes a circumferential surface configured to carry a developer layer containing toner, an additive, and carriers thereon. The toner carrier includes a circumferential surface configured to come into contact with the developer layer and to carry a toner layer by receiving toner from the developer layer so as to supply toner of the toner layer to the image carrier for developing the electrostatic latent image. The bias voltage control unit is configured to apply a bias voltage to the image carrier, the developer carrier, and the toner carrier, and to control the bias voltages. The detection unit is configured to electrically detect a toner adhesion condition with respect to the circumferential surface of the toner carrier.

When the detection unit detects adhesion of toner in excess of a threshold value, the bias voltage control unit changes bias voltage setting from an ordinary developing mode to a toner removing mode. In the toner removing mode, the bias voltage control unit sets the bias voltages to be applied to the image carrier, the developer carrier, and the toner carrier in such a manner that only the additive remains on the circumferential surface of the toner carrier, and the developer layer carried on the developer carrier comes into contact with the circumferential surface of the toner carrier with a large force as compared with the ordinary developing mode.

These and other objects, features and advantages of the present disclosure will become more apparent upon reading the following detailed description along with the accompanying drawings.

BRIEF DESCRIPTION OF THE DRAWINGS

FIG. 11 is a table illustrating an evaluation result on a toner adhesion condition with respect to the circumferential surface of the developing roller in examples and in a comparative example.

DETAILED DESCRIPTION

Figure 1:
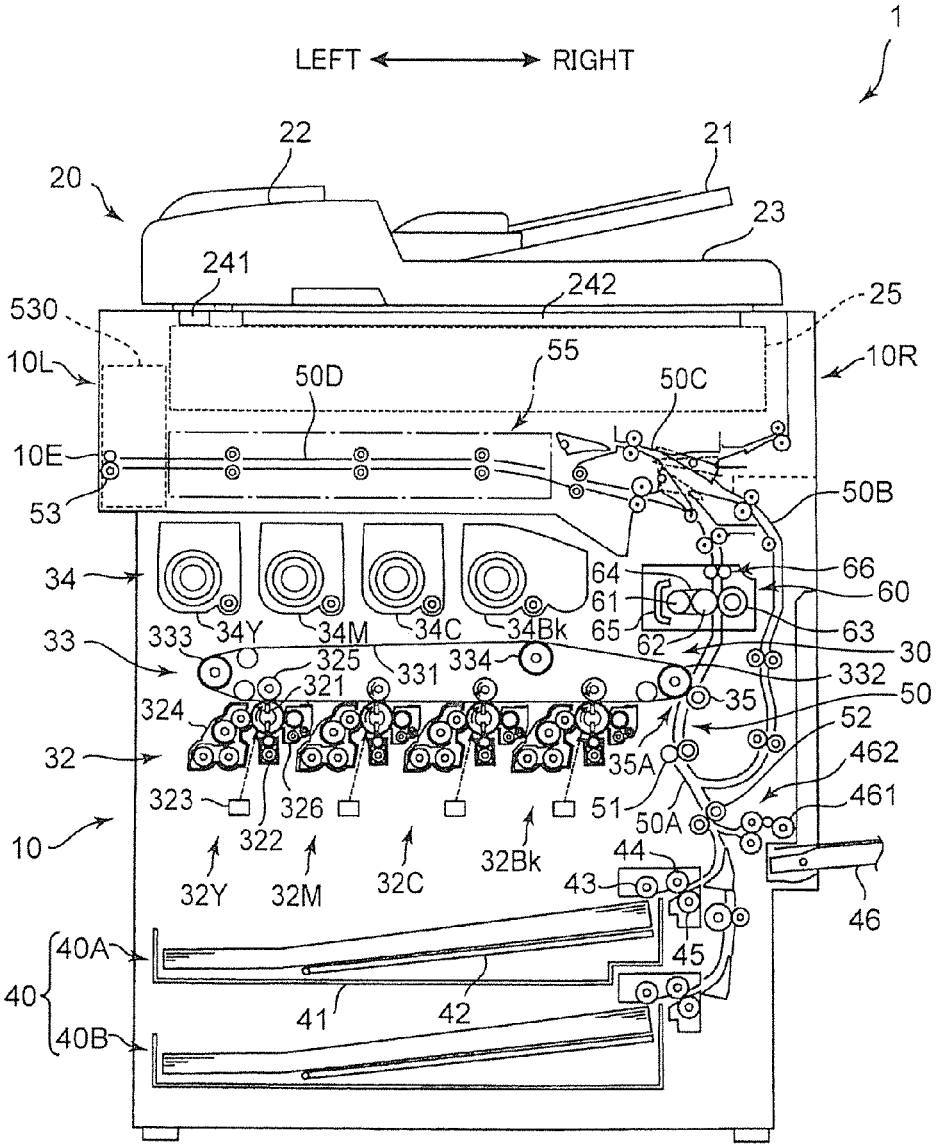
FIG. 1 is a cross-sectional view illustrating an embodiment of an image forming apparatus according to the present disclosure.

In the following, an embodiment of the present disclosure is described in detail referring to the drawings. FIG. 1 is a cross-sectional view illustrating an internal structure of an image forming apparatus 1 according to an embodiment of the present disclosure. In the specification, the image forming apparatus 1 is a copying machine. Alternatively, the image forming apparatus may be a printer, a facsimile machine, or a complex machine having the functions of these devices.

The image forming apparatus 1 is provided with an apparatus main body 10, and an automatic document feeder 20 disposed above the apparatus main body 10. The apparatus main body 10 is internally provided with a reading unit 25 configured to optically read a document image to be copied, an image forming assembly 30 configured to form a toner image on a sheet, a fixing unit 60 configured to fix the toner image on a sheet, a sheet storage unit 40 configured to store sheets to be transported to the image forming assembly 30, a transport path 50 along which a sheet is transported from the sheet storage unit 40 to a sheet discharge port 10E via the image forming assembly 30 and the fixing unit 60, and a transport unit 55 including a sheet transport path constituting a part of the transport path 50 therein.

The automatic document feeder 20 is configured to automatically feed a document sheet to be copied toward a predetermined document reading position (a position where a first contact glass 241 is mounted) in the apparatus main body 10. The automatic document feeder 20 includes a document tray 21 on which a document sheet is placed, a document transport unit 22 configured to transport a document sheet via the automatic document reading position, and a document discharge tray 23 on which a document sheet after image reading is discharged.

The reading unit 25 is configured to optically read the image of a document sheet through the first contact glass 241 for reading a document sheet to be automatically fed from the automatic document feeder 20 disposed above the top surface of the apparatus main body 10, or through a second contact glass 242 for reading a document sheet to be manually placed. A scanning mechanism (not illustrated) including a light source, a moving carriage, and a reflection mirror, and an imaging element (not illustrated) are housed in the reading unit 25.

The image forming assembly 30 is configured to form a full-color toner image and to transfer the formed full-color toner image on a sheet. The image forming assembly 30 includes an image forming unit 32 constituted of tandemly-disposed four units 32Y, 32M, 32C, and 32Bk respectively configured to form toner images of yellow (Y), magenta (M), cyan (C), and black (Bk); an intermediate transfer unit 33 disposed adjacent to and above the image forming unit 32; and a toner replenishing unit 34 disposed above the intermediate transfer unit 33.

Each of the image forming units 32Y, 32M, 32C, and 32Bk includes a photosensitive drum 321 (an image carrier), and also includes a charger 322, an exposure device 323, a developing device 324, a primary transfer roller 325, and a cleaning device 326 disposed around the photosensitive drum 321. The photosensitive drum 321 is configured to rotate around the axis thereof, and includes a circumferential surface configured to carry an electrostatic latent image and a toner image thereon. The charger 322 is configured to uniformly charge the surface of the photosensitive drum 321. The exposure device 323 includes an optical system device such as a laser light source, a mirror, and a lens. The exposure device 323 is configured to irradiate light onto the circumferential surface of the photosensitive drum 321, based on image data indicative of a document image for forming an electrostatic latent image.

The developing device 324 is configured to supply toner onto the circumferential surface of the photosensitive drum 321 in order to develop an electrostatic latent image formed on the photosensitive drum 321. The developing device 324 is a developing device of a touchdown developing method, and includes a screw feeder, a magnetic roller, and a developing roller. The details of the developing device 324 will be described later.

The primary transfer roller 325 is configured to form a nip portion with the photosensitive drum 321, with an intermediate transfer belt 331 provided in the intermediate transfer unit 33 being interposed between the primary transfer roller 325 and the photosensitive drum 321. The primary transfer roller 325 is configured to primarily transfer a toner image on the photosensitive drum 321 onto the intermediate transfer belt 331. The cleaning device 326 has a cleaning roller, and is configured to clean the circumferential surface of the photosensitive drum 321 after toner image transfer.

The intermediate transfer unit 33 is provided with the intermediate transfer belt 331, a driving roller 332, a driven roller 333, and a tension roller 334. The intermediate transfer belt 331 is an endless belt wound around the rollers 332, 333, 334, and the primary transfer roller 325. Toner images are transferred from the photosensitive drums 321 in the image forming units 32Y, 32M, 32C, and 32Bk one after another at a same position on the outer circumferential surface of the intermediate transfer belt 331 (primary transfer).

A secondary transfer roller 35 is disposed to face the circumferential surface of the driving roller 332. A nip portion between the driving roller 332 and the secondary transfer roller 35 serves as a secondary transfer unit 35A for transferring a full-color toner image obtained by superimposing the toner images of the respective colors on the intermediate transfer belt 331 onto a sheet. A secondary transfer bias voltage of a polarity opposite to the polarity of a toner image is applied to one of the driving roller 332 and the secondary transfer roller 35, and the other of the driving roller 332 and the secondary transfer roller 35 is grounded. The driven roller 333 is a roller configured to be driven in accordance with circulation of the intermediate transfer belt 331. The tension roller 334 is a roller configured to apply a predetermined tension force to the intermediate transfer belt 331.

The toner replenishing unit 34 includes a yellow toner container 34Y, a magenta toner container 34M, a cyan toner container 34C, and a black toner container 34Bk. These toner containers 34Y, 34C, 34M, and 34Bk are configured to respectively store toners of the respective colors, and to supply the toners of the respective colors to the developing devices 324 in the image forming units 32Y, 32M, 32C, and 32Bk corresponding to the respective colors of Y, M, C, and Bk via an unillustrated supply path.

The sheet storage unit 40 is provided with two sheet storage cassettes 40A and 40B configured to accommodate sheets for image formation. A sheet feeding tray 46 for manual feeding is provided on a right surface 10R of the apparatus main body 10.

The sheet storage cassette 40A (40B) is provided with a sheet accommodating portion 41 configured to accommodate a stack of sheets, and a lift plate 42 for lifting the sheet stack for sheet feeding. A pickup roller 43, and a roller pair constituted of a sheet feeding roller 44 and a retard roller 45 are disposed above a right end of the sheet storage cassette 40A (40B). By driving the pickup roller 43 and the sheet feeding roller 44, a sheet stack in the sheet storage cassette 40A is dispensed one by one from the uppermost sheet, and is transported to an upstream end of the transport path 50. Likewise, sheets placed on the sheet feeding tray 46 are transported to the transport path 50 by driving a pickup roller 461 and a sheet feeding roller 462.

The transport path 50 is constituted of a main transport path 50A along which a sheet is transported from the sheet storage unit 40 to the exit of the fixing unit 60 via the image forming assembly 30, an inversion transport path 50B configured to return a sheet after printing on one surface thereof to the image forming assembly 30 for double-sided printing, a switchback transport path 50C configured to direct a sheet from a downstream end of the main transport path 50A to an upstream end of the inverse transport path 50B, and a horizontal transport path 50D along which a sheet is horizontally transported from the downstream end of the main transport path 50A to the sheet discharge port 10E formed in a left surface 10L of the apparatus main body 10. The main portion of the horizontal transport path 50D is constituted of a sheet transport path provided in the transport unit 55.

A registration roller pair 51 is disposed on the upstream side of the main transport path 50A than the secondary transfer unit 35A. A sheet is temporarily stopped by the registration roller pair 51 in a stopped state for skew correction. Thereafter, the registration roller pair 51 is driven and rotated by a driving motor (not illustrated) at a predetermined timing for image transfer, whereby the sheet is fed to the secondary transfer unit 35A. In addition to the above, a plurality of transport rollers 52 for transporting a sheet are disposed on the main transport path 50A. The configurations of the transport paths 50B, 50C, and 50D are substantially the same as the main transport path 50A.

A sheet discharging unit 530 provided with a sheet discharge roller 53 is disposed at a most downstream end of the transport path 50 at a position adjacent to the transport unit 55. The sheet discharge roller 53 is configured to feed a sheet to an unillustrated post-processing device disposed on the left surface 10L of the apparatus main body 10 through the sheet discharge port 10E. The transport unit 55 is a unit configured to transport a sheet transported from the fixing unit 60 to the sheet discharge port 10E.

The fixing unit 60 is an induction heating fixing device configured to apply a fixing process of fixing a toner image on a sheet. The fixing unit 60 includes a heating roller 61, a fixing roller 62, a pressing roller 63, a fixing belt 64, an induction heating unit 65, and a transport roller pair 66. The pressing roller 63 comes into pressing contact with the fixing roller 62 to form a fixing nip portion. The heating roller 61 and the fixing belt 64 are inductively heated by the induction heating unit 65 to apply the heat of the heating roller 61 and the fixing belt 64 to the fixing nip portion. Allowing a sheet to pass through the fixing nip portion makes it possible to fix a toner image transferred to the sheet onto the sheet.

Figure 2:
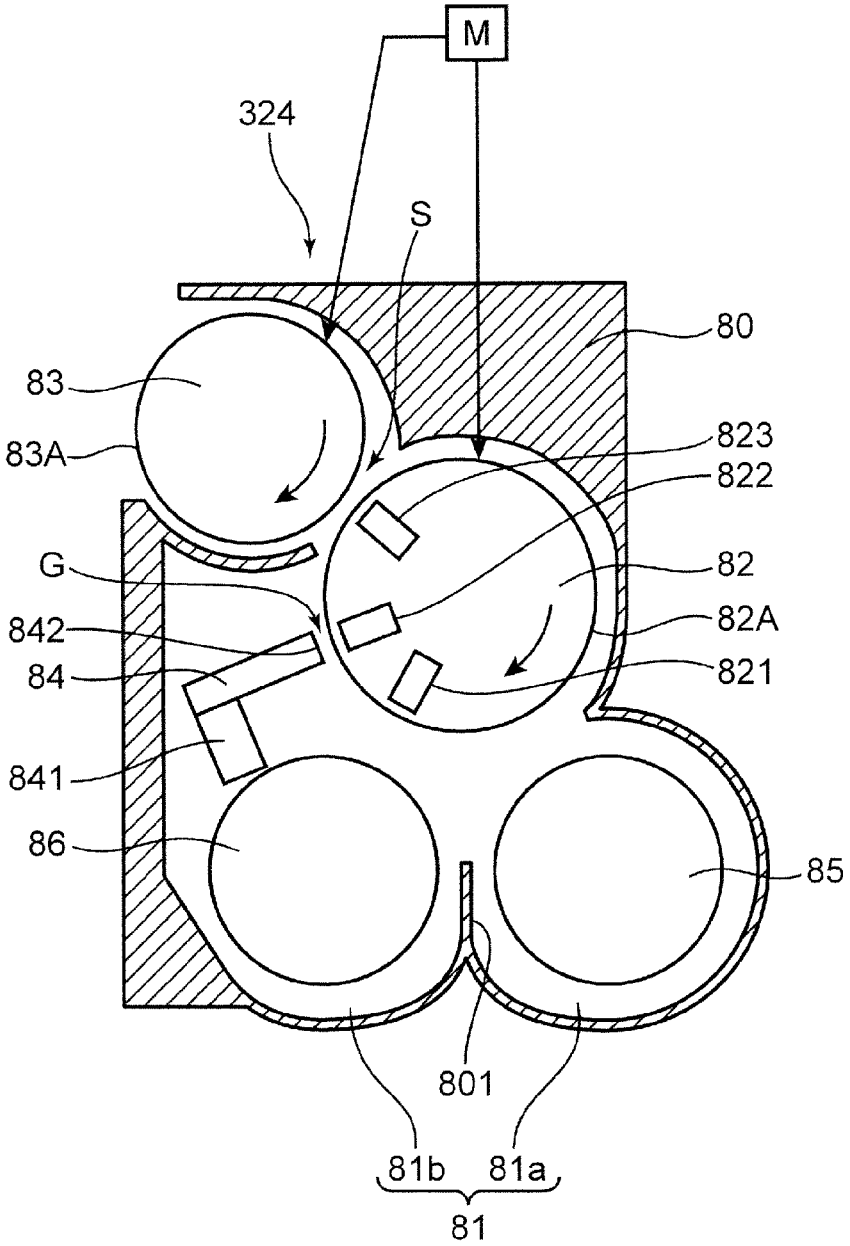
FIG. 2 is a vertical sectional view of a developing device.
Figure 3:
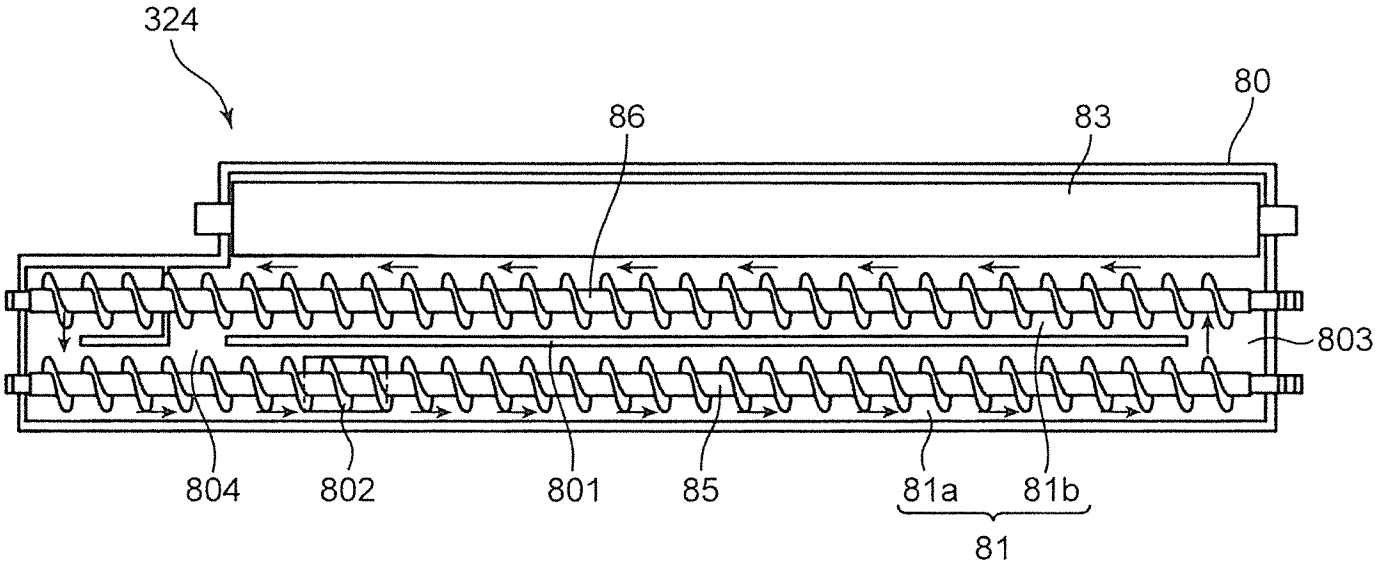
FIG. 3 is a horizontal sectional view of the developing device.

Next, the developing device 324 is described in details. FIG. 2 is a vertical sectional view schematically illustrating an internal structure of the developing device 324. FIG. 3 is a horizontal sectional view of the developing device 324. The developing device 324 includes a developing housing 80 configured to define the internal space of the developing device 324. The developing housing 80 is provided with a developer storage unit 81 as a cavity for storing a developer therein and capable of transporting the developer while agitating the developer. Further, a magnetic roller 82 (a developer carrier) disposed above the developer storage unit 81, a developing roller 83 (a toner carrier) disposed to face the magnetic roller 82 at a position obliquely above the magnetic roller 82, and a developer restricting blade 84 disposed to face the magnetic roller 82 are housed in the developing housing 80.

The developer used in the embodiment is a developer containing toner, an additive, and carriers. The toner contains a binder resin, a coloring agent, and a charge control agent; and may be manufactured by a pulverization method or a polymerization method. The charging polarity of toner may be a positive charging polarity (a first polarity) or a negative charging polarity (a second polarity). Examples of the binder resin are styrene resin, acrylic resin, polyethylene resin, polyester resin, polypropylene resin, and styrene-acrylic resin. The coloring agent may be a pigment of yellow, magenta, cyan, or black. The charge control agent is added in order to enhance the charging performance of toner. In positively charging the toner at the time of developing, a compound having positive chargeability such as a nigrosine compound is used, and in negatively charging the toner at the time of developing, a compound having negative chargeability such as a chelate compound is used. In addition to the above, waxes may be contained in order to enhance the fixing performance.

The additive is an agent to be added in order to enhance fluidity of toner, prevent adhesion between binder resins, adjust an adhesion force of toner with respect to a member (such as the developing roller 83) in contact with toner, and control chargeability of toner. Various materials capable of exhibiting the above functions may be used as the additive. Examples of the additive are titanium oxide, silica, and aluminium oxide. As will be described later, in the embodiment, the additive is used as a polishing agent on the circumferential surface of the developing roller 83. In view of the above, it is desirable to use a hard material as the additive. Further, the charging polarities of the toner and the additive are desirably opposite to each other in order to preferentially fly only the additive from a developer layer carried on the magnetic roller 82 toward the developing roller 83 by electric force. In view of the above points described above, in the case where toner is positively charged, it is preferable to use titanium oxide having a high surface hardness and negative chargeability. In particular, titanium oxide is advantageously used, because titanium oxide has a low resistance value and does not affect chargeability of toner.

The carrier is a material for transporting toner in order to frictionally charge the toner. The carrier has a charging polarity opposite to the charging polarity of toner. Examples of the carriers are obtained by coating the surface of magnetic carriers such as magnetite carriers, Mn-based ferrite, or Mn—Mg-based ferrite, with resin. Examples of the resin for coating are fluorocarbon resin in the case where carriers have positive chargeability, and silicon-based resin in the case where carriers have negative chargeability.

In the following description, there is used a developer, in which toner is positively charged, and the additive and the carriers have negative chargeability. Referring to FIG. 2 and FIG. 3, the developer storage unit 81 includes developer storage chambers 81*a* and 81*b* adjacent to each other and extending in the longitudinal direction of the developing device 324. The developer storage chambers 81*a* and 81*b* are separated from each other by a partition plate 801 integrally formed with the developing housing 80 and extending in the longitudinal direction. As illustrated in FIG. 3, the developer storage chambers 81*a* and 81*b* communicate with each other by communication paths 803 and 804 at both ends of the developer storage chambers 81*a* and 81*b* in the longitudinal direction. Screw feeders 85 and 86 configured to agitate and transport the developer by rotating around the axes thereof are respectively housed in the developer storage chambers 81*a* and 81*b*. The screw feeders 85 and 86 are driven and rotated by an unillustrated driving mechanism in directions opposite to each other. By performing the above operation, as illustrated by the arrow in FIG. 3, the developer is circulated and transported while being agitated between the developer storage chamber 81*a* and the developer storage chamber 81*b*. By the agitation, the toner and the carriers are mixed with each other, and the toner is positively charged with the first polarity. Toner is replenished to the developer storage chamber 81*a* in the developing housing 80 through a toner replenishment port 802.

The magnetic roller 82 is disposed along the longitudinal direction of the developing device 324, and is rotatable clockwise in FIG. 2. A fixed-type magnet roll (not illustrated) is disposed inside of the magnetic roller 82. The magnet roll has plural magnetic poles. In the embodiment, the magnet roll has an attracting pole 821, a restricting pole 822, and a main pole 823. The attracting pole 821 faces the developer storage unit 81, the restricting pole 822 faces a developer restricting blade 84, and the main pole 823 faces the developing roller 83.

The magnetic roller 82 magnetically attracts (receives) the developer from the developer storage unit 81 onto a circumferential surface 82A of the magnetic roller 82 by the magnetic force of the attracting pole 821. The attracted developer is magnetically carried on the circumferential surface 82A of the magnetic roller 82 as a developer layer (a magnetic brush layer), and is transported toward the developer restricting blade 84, as the magnetic roller 82 is rotated.

The developer restricting blade 84 is disposed on the upstream side than the developing roller 83 as viewed from the rotating direction of the magnetic roller 82, and is configured to restrict the layer thickness of the developer layer magnetically adhered to the circumferential surface 82A of the magnetic roller 82. The developer restricting blade 84 is a plate member made of a magnetic material and extending along the longitudinal direction of the magnetic roller 82. The developer restricting blade 84 is supported by a predetermined support member 841 fixed at an appropriate position of the developing housing 80. Further, the developer restricting blade 84 has a restricting surface 842 (a distal end surface of the developer restricting blade 84) which defines a predetermined restriction gap G between the circumferential surface 82A of the magnetic roller 82 and the developer restricting blade 84.

The developer restricting blade 84 made of a magnetic material is magnetized by the restricting pole 822 of the magnetic roller 82. According to the above configuration, a magnetic path is formed between the restricting surface 842 of the developer restricting plate 84, and the restricting pole 822, in other words, within the restriction gap G. When a developer layer adhered to the circumferential surface 82A of the magnetic roller 82 is transported into the restriction gap G, as the magnetic roller 82 is rotated, the layer thickness of the developer layer is restricted in the restriction gap G. Thus, a developer layer of a predetermined uniform thickness is formed on the circumferential surface 82A.

The developing roller 83 is disposed to extend along the longitudinal direction of the developing device 324 in parallel to the magnetic roller 82, and is rotatable clockwise in FIG. 2. The developing roller 83 has a circumferential surface 83A configured to receive toner from the developer layer and to carry a toner layer, while rotating in a state in contact with the developer layer held on the circumferential surface 82A of the magnetic roller 82. At the time of developing, toner of the toner layer is supplied to the circumferential surface of the photosensitive drum 321 for developing an electrostatic latent image.

The developing roller 83 and the magnetic roller 82 are driven and rotated by a driving source M. A clearance S of a predetermined size is formed between the circumferential surface 83A of the developing roller 83 and the circumferential surface 82A of the magnetic roller 82. The clearance S is set to the size of e.g. about 130 μm. The developing roller 83 is disposed to face the photosensitive drum 321 through an opening formed in the developing housing 80. A clearance of a predetermined size (e.g. about 110 μm) is formed between the circumferential surface 83A and the circumferential surface of the photosensitive drum 321.

Figure 4:
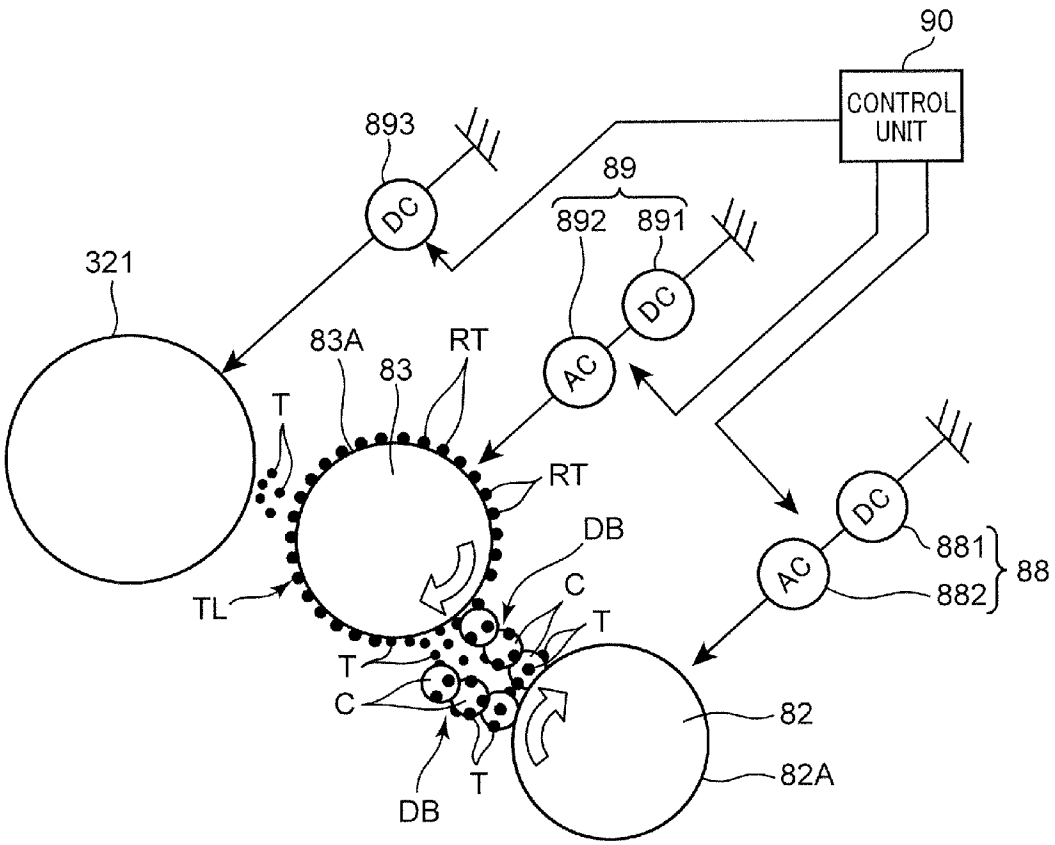
FIG. 4 is a schematic diagram for describing a developing operation to be performed by the developing device.

Next, referring to FIG. 4, there are described a configuration for applying a bias voltage and a developing operation to be performed by the developing device 324 employing a touchdown developing method. In the embodiment, there are provided bias voltage setting such that a bias voltage is applied to the developing device 324 at the time of ordinary image formation (in the ordinary developing mode), and bias voltage setting such that a bias voltage is applied in removing toner adhered to the circumferential surface 83A of the developing roller 83 (in the toner removing mode). First of all, a configuration of applying a bias voltage in the ordinary developing mode is described.

In order to control a developing operation, the developing device 324 further includes a first application unit 88, a second application unit 89 and a third application unit 893 (a part of a bias voltage control unit), and a control unit 90 (a part of a bias voltage control unit) configured to control the first application unit 88, the second application unit 89, and the third application unit 893. The first application unit 88 has a DC voltage source 881 and an AC voltage source 882 connected in series to each other, and is connected to the magnetic roller 82. A voltage obtained by superimposing an AC bias voltage output from the AC voltage source 882 to a DC bias voltage output from the DC voltage source 881 is applied to the magnetic roller 82. The second application unit 89 has a DC voltage source 891 and an AC voltage source 892 connected in series to each other, and is connected to the developing roller 83. A voltage obtained by superimposing an AC bias voltage output from the AC voltage source 892 to a DC bias voltage output from the DC voltage source 891 is applied to the developing roller 83. The third application unit 893 includes a DC voltage source, and is configured to apply a DC bias voltage to the photosensitive drum 321.

A mechanism for developing an electrostatic latent image on the photosensitive drum 321 is described. After the layer thickness of the magnetic brush layer on the circumferential surface 82A of the magnetic roller 82 is controlled to be uniform by the developer restricting blade 84, the magnetic brush layer is conveyed toward the developing roller 83, as the magnetic roller 82 is rotated. Thereafter, a magnetic brush DB constituted of multitudes of magnetic brush bristles in the magnetic brush layer comes into contact with the circumferential surface 83A of the rotating developing roller 83 in a region of the clearance S (see FIG. 2).

During the above operation, the control unit 90 respectively controls the first application unit 88 and the second application unit 89 to apply a predetermined DC bias voltage and a predetermined AC bias voltage to the magnetic roller 82 and to the developing roller 83. As a result of the voltage application, a predetermined potential difference is generated between the circumferential surface 82A of the magnetic roller 82 and the circumferential surface 83A of the developing roller 83. Due to the potential difference, only the particles of toner T are conveyed from the magnetic brush DB to the circumferential surface 83A at a position where the circumferential surface 82A and the circumferential surface 83A face each other (at a position where the main pole 823 (see FIG. 2) and the circumferential surface 83A face each other), and the carriers C in the magnetic brush DB remain on the circumferential surface 82A. By performing the above operation, a toner layer TL of a predetermined thickness is carried on the circumferential surface 83A of the developing roller 83. In the embodiment, the particles of toner T are positively charged. Therefore, the positive potential of the circumferential surface 82A is set to be higher than the positive potential of the circumferential surface 83A.

The toner layer TL on the circumferential surface 83A is conveyed toward the circumferential surface of the photosensitive drum 321, as the developing roller 83 is rotated. The control unit 90 controls the third application unit 893 to apply a DC bias voltage to the photosensitive drum 321 so that a predetermined potential difference is generated between the circumferential surface of the photosensitive drum 321 and the circumferential surface 83A of the developing roller 83. Due to the potential difference, the particles of toner T of the toner layer TL are conveyed to the circumferential surface of the photosensitive drum 321 (supply of toner). By performing the above operation, an electrostatic latent image on the circumferential surface of the photosensitive drum 321 is developed, and a toner image is formed. An operation (a refresh operation) of forcibly discharging toner on the developing roller 83 to the photosensitive drum 321, which is executed at a timing other than the image formation time, is substantially the same operation as the aforementioned developing operation.

Figure 5:
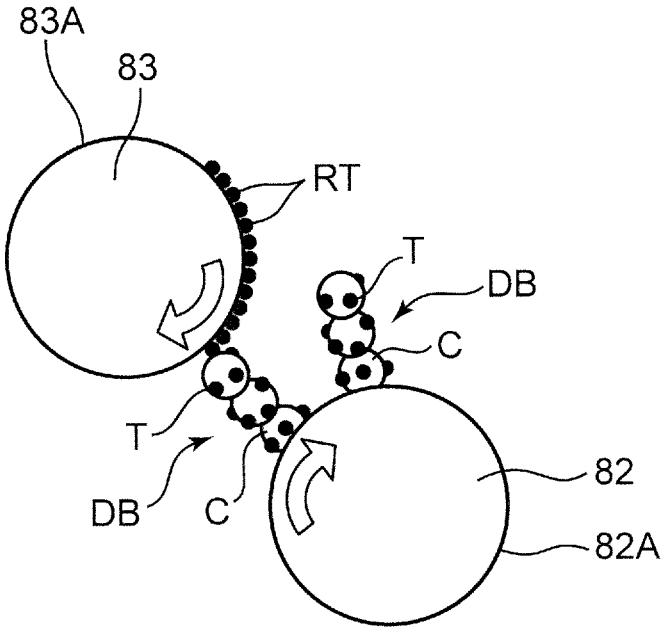
FIG. 5 is a schematic diagram for describing an operation of recovering toner from a developing roller.

FIG. 5 is a schematic diagram for describing an operation of recovering toner from the developing roller 83 to the magnetic roller 82 side. The recovering operation is executed, for instance, during a sheet interval after finish of a toner image transfer process on a sheet until a toner image transfer process on a next sheet is performed, or after a print job is finished.

In an actual developing operation, toner residues RT that are not conveyed to the photosensitive drum 321 remain on the circumferential surface 83A, out of the toner T of the toner layer TL. The toner residues RT are recovered by a scraping force by the magnetic brush DB and by electric force between the magnetic roller 82 and the developing roller 83 when the toner residues RT are conveyed to a position where the circumferential surface 83A and the circumferential surface 82A of the magnetic roller 82 face each other, as the developing roller 83 is rotated. When the magnetic brush DB carrying the recovered toner residues RT is conveyed downstream than the main pole 823, as the magnetic roller 82 is rotated, the magnetic brush DB is peeled off from the circumferential surface 82A by the magnetic force of a peeling pole (not illustrated) of the magnet roll, and is returned to the developer storage unit 81 (see FIG. 2).

The aforementioned recovering operation is accomplished by inverting the potential difference between the magnetic roller 82 and the developing roller 83. Temporarily inverting the potential difference during a sheet interval and after finish of a print job with respect to the potential difference at the time of developing as described above makes it possible to forcibly peel off the toner residues RT from the developing roller 83 and to clean the circumferential surface 83A. Accordingly, at the time of developing with respect to a sheet next time, a toner layer TL on the developing roller 83 is formed of toner T that is newly supplied from the developer storage unit 81. In other words, replacement of toner T for forming a toner layer TL is accomplished.

The aforementioned recovering operation is effective when toner T remains in a state that the toner T is simply carried on the circumferential surface 83A of the developing roller 83. However, there is a case that toner is adhered to the circumferential surface 83A in a state that it is difficult to peel off the toner. For instance, toner for low temperature fixation may be used, and a low melting point component may be adhered to the circumferential surface 83A. When toner is adhered to the circumferential surface 83A, particularly, to such an extent that a layer of a certain thickness is formed, the surface resistance of the circumferential surface 83A may increase. As a result, toner may not fly as intended, the developing performance may be lowered, and an image formation failure may occur. If a high DC bias voltage and a high AC bias voltage are applied to the developing roller 83, it is possible to fly the toner. However, since there is a capacity limit in a transformer used in a power supply circuit, it may be impossible to take the above measure according to a condition.

In order to cope with the aforementioned problem on toner adhesion, the image forming apparatus 1 of the embodiment is configured such that the toner removing mode of polishing the circumferential surface 83A with use of an additive contained in the developer as a polishing agent is executable when it is detected that toner in excess of a predetermined threshold value is adhered to the circumferential surface 83A of the developing roller 83. In the toner removing mode, the control unit 90 sets a bias voltage to be applied to the photosensitive drum 321, the magnetic roller 82, and the developing roller 83 in such a manner that only the additive remains on the circumferential surface 83A, and a developer layer carried on the circumferential surface 82A of the magnetic roller 82 comes into contact with the circumferential surface 83A with a large force, as compared with the ordinary developing mode. This point will be described in details in the following.

Figure 6:
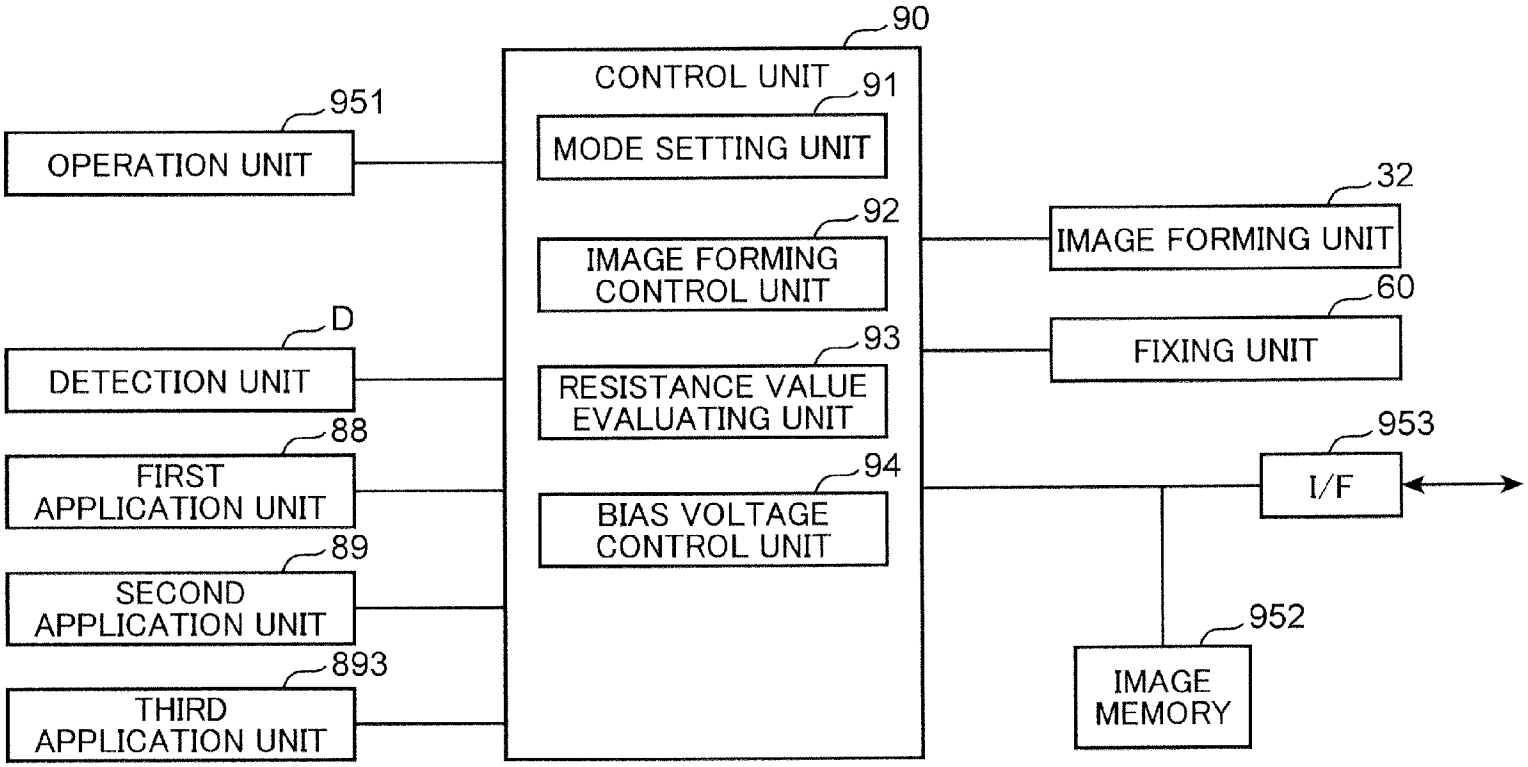
FIG. 6 is a functional block diagram of a control unit.

An electrical configuration of the image forming apparatus 1 capable of executing the toner removing mode, in addition to the ordinary developing mode is described. The image forming apparatus 1 is provided with the control unit 90 configured to control the overall operation of the respective parts of the image forming apparatus 1, including the aforementioned bias control function. FIG. 6 is a functional block diagram of the control unit 90. The control unit 90 is constituted of a CPU (Central Processing Unit), an ROM (Read Only Memory) for storing a control program, and an RAM (Random Access Memory) to be used as a working area for the CPU. The image forming apparatus 1 is further provided with an operation unit 951, an image memory 952, an I/F (interface) 953, and a detection unit D (a part of a detection unit), in addition to the configuration described referring to FIG. 1 to FIG. 5.

The operation unit 951 is provided with a liquid crystal touch panel, a numeric key pad, a start key, and a setting key, and is configured to receive user's operations and various settings with respect to the image forming apparatus 1.

The image memory 952 temporarily stores image data to be printed, which is received from an external device such as a personal computer, when the image forming apparatus 1 functions as a printer. Further, when the image forming apparatus 1 functions as a copying machine, the image memory 952 temporarily stores image data optically read by the automatic document feeder 20.

The I/F 953 is an interface circuit configured to implement data communication with an external device. The I/F 953 is configured to generate a communication signal in accordance with a communication protocol of a network connecting between the image forming apparatus 1 and the external device, and to convert the communication signal from the network side into data processable by the image forming apparatus 1. A printing instruction signal to be transmitted from a personal computer or the like is received by the control unit 90 via the I/F 953, and image data is stored in the image memory 952 via the I/F 953.

The control unit 90 functions as a mode setting unit 91, an image forming control unit 92, a resistance value evaluating unit 93 (a part of a detection unit), and a bias voltage control unit 94 by causing the CPU to execute a control program stored in the ROM.

The mode setting unit 91 is configured to switch the operation mode of the image forming apparatus 1 (developing device 324) between the ordinary developing mode (including the aforementioned recovering operation) in which a toner image to be transferred to a sheet is formed on the photosensitive drum 321, and the toner removing mode in which toner adhered to the circumferential surface 83A of the developing roller 83 is removed. The mode setting unit 91 is configured to change the operation mode from the ordinary developing mode to the toner removing mode, when the resistance value evaluating unit 93 detects toner adhesion in excess of a threshold value to the circumferential surface 83A, based on a measurement result by the detection unit D.

When the ordinary developing mode is set, the image forming control unit 92 controls the respective parts in the image forming assembly 30 and in the fixing unit 60 to execute an image forming operation with respect to a sheet, based on printing instruction information given from the operation unit 951, or based on printing instruction information given from an external device via the I/F 953. On the other hand, when the toner removing mode is set, an image forming operation is not performed, but the image forming control unit 92 causes the photosensitive drum 321, the magnetic roller 82, and the developing roller 83 to drive and rotate (hereinafter, called as aging drive) with application of a predetermined bias voltage so as to remove the toner adhered to the circumferential surface 83A by the magnetic brush and the additive.

The resistance value evaluating unit 93 is configured to obtain an evaluation value relating to a toner adhesion condition with respect to the circumferential surface 83A of the developing roller 83, based on an electrical measurement value to be detected by the detection unit D.

The detection unit D is configured to measure a parameter that changes based on a variation in electrical resistance value of the circumferential surface 83A. Further, the resistance value evaluating unit 93 performs a process of determining whether toner in excess of a threshold value is adhered to the circumferential surface 83A, based on the evaluation value.

As described above referring to FIG. 4, the bias voltage control unit 94 is configured to apply a bias voltage to the photosensitive drum 321, the magnetic roller 82, and the developing roller 83 via the first application unit 88, the second application unit 89, and the third application unit 893, and to control the bias voltages. When the mode setting unit 91 sets the ordinary developing mode, the bias voltage control unit 94 applies a bias voltage suitable for a developing operation to the photosensitive drum 321, the magnetic roller 82, and the developing roller 83.

On the other hand, when the resistance value evaluating unit 93 detects toner adhesion in excess of a threshold value to the circumferential surface 83A, and the mode setting unit 91 sets the toner removing mode, the bias voltage control unit 94 changes the bias voltages to be applied to those in the toner removing mode. Specifically, the bias voltage control unit 94 sets a DC bias voltage in such a manner that the electric potential of the developing roller 83 is higher on the positive polarity (first polarity) between the photosensitive drum 321 and the developing roller 83, and between the magnetic roller 82 and the developing roller 83. By performing the above operation, only the additive remains on the circumferential surface 83A of the developing roller 83. Further, the bias voltage control unit 94 sets the AC bias voltage to be applied to the magnetic roller 82 to be higher than in the ordinary developing mode. By performing the above operation, it is possible to electrically increase the pressing force of carriers with respect to the circumferential surface 83A, and to increase the contact force of the magnetic brush DB (developer layer) with respect to the circumferential surface 83A. Allowing the image forming control unit 92 to perform the aforementioned aging drive, with application of the bias voltages as described above, makes it possible to implement an operation of polishing the circumferential surface 83A, with use of the additive as a polishing agent, and with use of the developer layer as a brush.

Figure 7A:
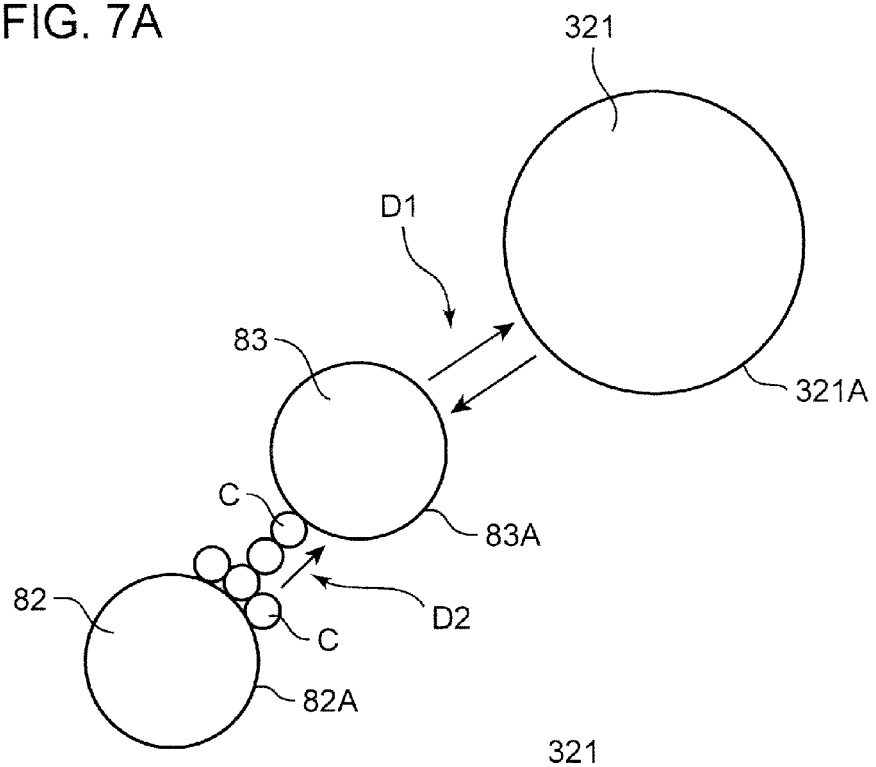
FIGS. 7A and 7B are schematic diagrams for describing an electrical condition before and after toner adhesion to the circumferential surface of the developing roller.

Referring to FIG. 7A to FIG. 9, a practical example of the detection unit D, and the details of a polishing operation are described. FIGS. 7A and 7B are schematic diagrams for describing an electrical condition before and after toner adhesion to the circumferential surface 83A of the developing roller 83. FIG. 7A illustrates a case, in which a toner layer is not formed on the circumferential surface 83A, and FIG. 7B illustrates a case, in which a toner layer TLa is formed on the circumferential surface 83A.

When the toner layer TLa is not formed, the resistance value of the circumferential surface 83A of the developing roller 83 is a predetermined value. Accordingly, a leak voltage D1 between a circumferential surface 321A of the photosensitive drum 321 and the circumferential surface 83A of the developing roller 83 also has a predetermined voltage value. The leak voltage D1 is a voltage (discharge start voltage) at which discharge is generated between the circumferential surface 321A and the circumferential surface 83A when a voltage is applied between the photosensitive drum 321 and the developing roller 83. Further, a flow-in current D2 flowing between the developing roller 83 and the magnetic roller 82 also has a predetermined current value. The flow-in current D2 is a current flowing between the circumferential surface 83A of the developing roller 83 and the circumferential surface 82A of the magnetic roller 82 via a developer layer (carriers) carried on the circumferential surface 82A at the time of developing.

Figure 7B:
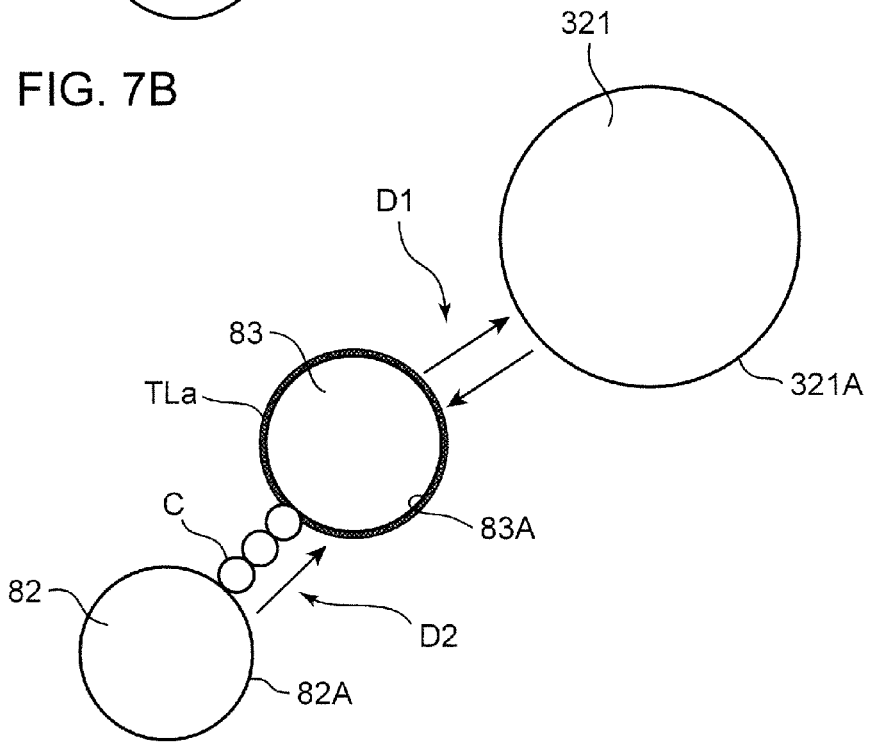

On the other hand, as illustrated in FIG. 7B, when the toner layer TLa is formed on the circumferential surface 83A, the resistance value of the circumferential surface 83A increases, as compared with an initial value, because toner is an insulating material. When the resistance value of the circumferential surface 83A increases, the leak voltage D1 increases, as compared with the predetermined voltage value. Further, the flow-in current D2 decreases, as compared with the predetermined current value.

Therefore, as an embodiment, the detection unit D may be constituted as a voltage detecting mechanism for detecting the leak voltage D1. In this case, the resistance value evaluating unit 93 stores, in an unillustrated memory, a threshold value voltage obtained by checking in advance a relationship between the thickness of the toner layer TLa (the degree of toner adhesion to the circumferential surface 83A) and the leak voltage D1. The resistance value evaluating unit 93 compares between the threshold value voltage and the leak voltage D1 detected by the voltage detecting mechanism at a predetermined sampling period (corresponding to the number of sheets to be printed), or at the time of start or stop of the image forming apparatus 1; and determines that toner in excess of a threshold value adheres to the circumferential surface 83A when the leak voltage D1 is over the threshold value voltage.

As another embodiment, the detection unit D may be constituted as a current detecting mechanism for detecting the flow-in current D2. In this case, the resistance value evaluating unit 93 stores, in an unillustrated memory, a threshold value current obtained by checking in advance a relationship between the thickness of the toner layer TLa (the degree of adhesion to the circumferential surface 83A) and the flow-in current D2. The resistance value evaluating unit 93 compares between the threshold value current and the flow-in current D2 detected by the current detecting mechanism at a predetermined sampling period, or at the time of start or stop of the image forming apparatus 1; and determines that toner in excess of a threshold value adheres to the circumferential surface 83A when the flow-in current D2 is under the threshold value current.

Subsequently, a polishing operation to be performed when the mode setting unit 91 sets the toner removing mode is described referring to FIG. 8 and FIG. 9. A DC bias voltage to be applied to the magnetic roller 82, the developing roller 83, and the photosensitive drum 321 relatively largely affects the conveyance of toner and an additive. Further, an AC bias voltage to be applied to the magnetic roller 82 relatively largely affects the fly state of carriers (a reciprocating operation of carries between the circumferential surface 82A and the circumferential surface 83A).

Figure 8:
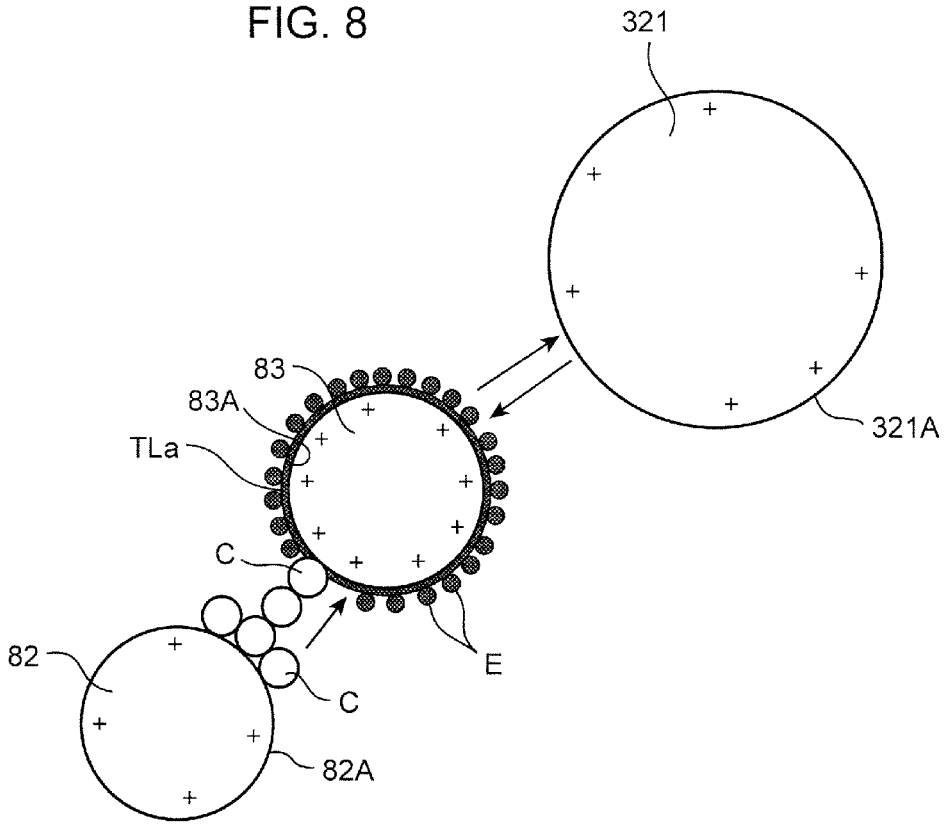
FIG. 8 is a schematic diagram for describing an operation in a state that a bias voltage is applied in the toner removing mode.

FIG. 8 illustrates a state that only an additive E having negative chargeability remains on the circumferential surface 83A of the developing roller 83, out of the three components i.e. toner, the additive, and carriers of the developer. Let it be assumed that MagDC denotes a DC bias voltage to be applied to the magnetic roller 82, SlvDC denotes a DC bias voltage to be applied to the developing roller 83, and DrmDC denotes a DC bias voltage to be applied to the photosensitive drum 321. In the toner removing mode, the bias voltage control unit 94 sets the DC bias voltages MagDC, SlvDC, and DrmDC to be a plus bias voltage. The bias voltage control unit 94 sets the bias voltages to satisfy:

MagDC<SlvDC, and SlvDC>DrmDC.

Setting the DC bias voltages to satisfy MagDC<SlvDC allows the toner having positive chargeability to remain in the developer layer carried on the circumferential surface 82A of the magnetic roller 82, and allows only the additive E having negative chargeability to fly from the developer layer to the circumferential surface 83A of the developing roller 83. Further, setting the DC bias voltages to satisfy SlvDC>DrmDC restricts the additive E carried on the circumferential surface 83A from flying toward the circumferential surface 321A of the photosensitive drum 321, and as a result, the additive E remains on the circumferential surface 83A. In other words, by setting the bias voltages as described above, there is established an electrical condition, in which the additive E remains on the circumferential surface 83A, out of the three components of the developer.

In the ordinary developing mode, the bias voltage control unit 94 sets the bias voltages to satisfy:

MagDC>SlvDC, and SlvDC>DrmDC.

Assuming that M1 denotes a DC bias voltage in the ordinary developing mode, and M2 denotes a DC bias voltage in the toner removing mode, the bias voltage control unit 94 sets the bias voltages to satisfy the following:

MagDC(M1)>MagDC(M2)

SlvDC(M1)<SlvDC(M2)

DrmDC(M1)<DrmDC(M2)

Further, the bias voltage control unit 94 sets MagDC to be a minus DC bias voltage at the time of recovering in the ordinary developing mode. This makes it possible to recover the positively charged toner remaining on the circumferential surface 83A without being supplied to the photosensitive drum 321 (the toner that is not strongly adhered to the circumferential surface) on the magnetic roller 82 side in a satisfactory manner by electrical assistance of the minus DC bias voltage MagDC.

Figure 9:
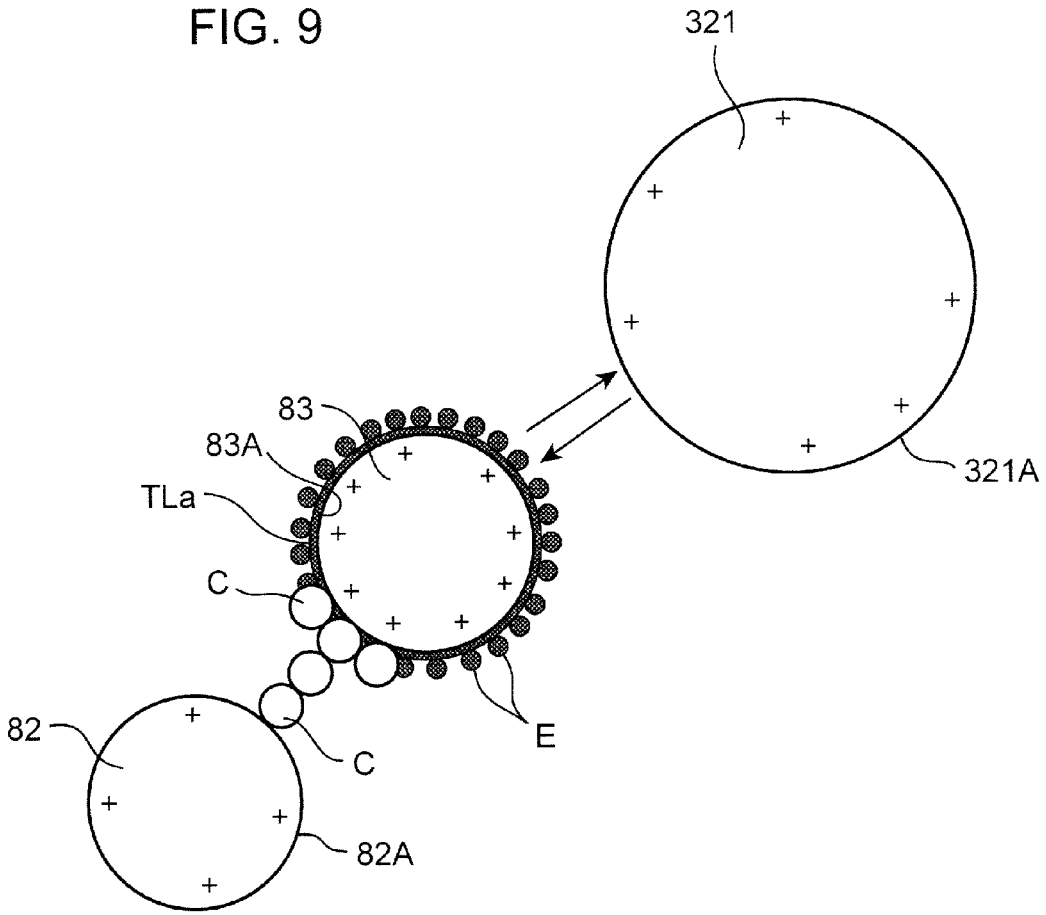
FIG. 9 is a schematic diagram for describing an operation in a state that a bias voltage is applied in the toner removing mode.

FIG. 9 illustrates a state that the circumferential surface 83A of the developing roller 83 is polished by the developer layer (carriers C) on the circumferential surface 82A of the magnetic roller 82. In this state, the carriers C come into contact with the circumferential surface 83A with a strong pressing force, as compared with the ordinary developing mode. In order to electrically obtain the above state, the bias voltage control unit 94 sets an AC bias voltage MagVpp to be applied to the magnetic roller 82 to be higher in the toner removing mode than in the ordinary developing mode.

By setting the AC bias voltage as described above, the force with which the developer layer on the circumferential surface 82A comes into contact with the circumferential surface 83A increases. In other words, the reciprocating movement of the carriers C between the circumferential surface 82A and the circumferential surface 83A is activated, and the amount of carriers C remaining on the circumferential surface 83A increases, and the power (polishing power) of the magnetic brush increases, as compared with the ordinary developing mode. When the image forming control unit 92 controls the photosensitive drum 321, the magnetic roller 82, and the developing roller 83 for aging drive in the above state, the developer layer (magnetic brush) on the circumferential surface 82A strongly comes into contact with the circumferential surface 83A where the toner layer TLa is formed. Since the additive E remains on the circumferential surface 83A, the additive E functions as a polishing agent. This makes it possible to increase the polishing performance with respect to the circumferential surface 83A, and to scrape off the toner layer TLa in a satisfactory manner.

Figure 10:
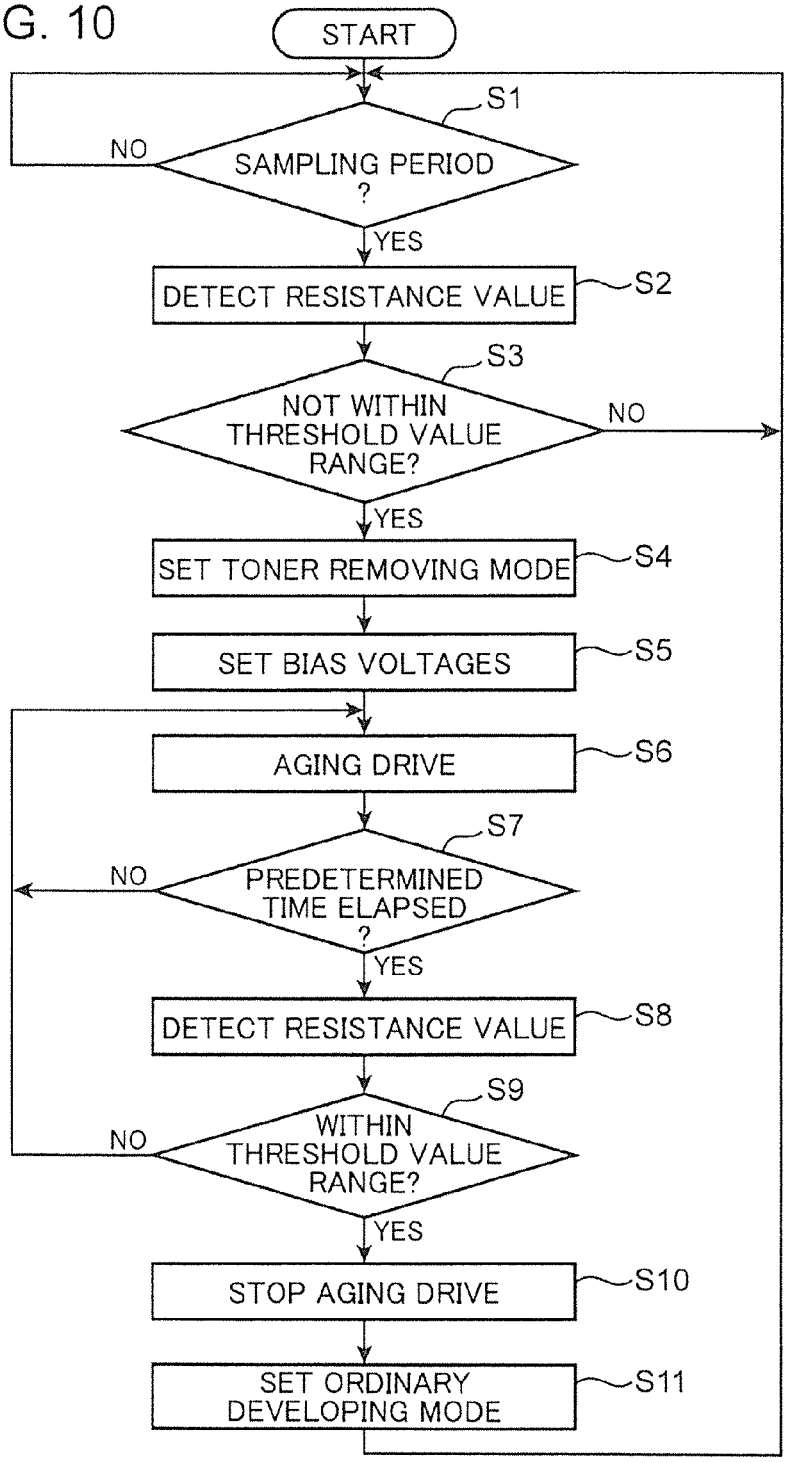
FIG. 10 is a flowchart illustrating an operation to be performed by the control unit in the toner removing mode.

Subsequently, an operation to be performed by the control unit 90 in the toner removing mode is described referring to the flowchart of FIG. 10. In a state that an ordinary image forming operation is performed by the image forming apparatus 1 (in a state that the mode setting unit 91 sets the ordinary developing mode), the control unit 90 determines whether a sampling period of detecting a resistance value of the circumferential surface 83A of the developing roller 83 has come (in Step S1). Typically, as the number of times of image forming processes with respect to a sheet increases, toner is likely to adhere to the circumferential surface 83A. In view of this, it is desirable to determine whether the sampling period has come, based on a judgment as to whether the number of sheets subjected to image formation has reached a predetermined number. For instance, it is possible to determine that the sampling period has come, based on a judgment as to whether the number of processed sheets has reached 1,000 sheets, for instance, based on detection of a resistance value last time.

In the case where the sampling period has not come (NO in Step S1), the control unit 90 waits. On the other hand, in the case where the sampling period has come (YES in Step S1), the resistance value evaluating unit 93 in the control unit 90 acquires a measurement value (the leak voltage D1 or the flow-in current D2) relating to the resistance value on the circumferential surface 83A from the detection unit D (in Step S2). Subsequently, the resistance value evaluating unit 93 determines whether the acquired measurement value is not within a predetermined threshold value range (in Step S3). Specifically, in the case where a measurement value of the leak voltage D1 is obtained, it is determined whether the leak voltage D1 is over a predetermined threshold value voltage. In the case where a measurement value of the flow-in current D2 is obtained, it is determined whether the flow-in current D2 is under a predetermined threshold value current. In other words, it is determined whether toner in excess of a threshold value is adhered to the circumferential surface 83A.

In the case where the measurement value lies within the threshold value range (NO in Step S3), toner in excess of a threshold value is not adhered to the circumferential surface 83A. Accordingly, a toner removing process is not performed, and the control returns to Step S1, and the control unit 90 waits for arrival of a next sampling period. On the other hand, in the case where the measurement value is not within the threshold value range (YES in Step S3), toner in excess of a threshold value is adhered to the circumferential surface 83A. In this case, the resistance value evaluating unit 93 transmits a determination signal indicative of toner in excess of a threshold value to the mode setting unit 91. In response to receiving the determination signal, the mode setting unit 91 changes the operation mode of the image forming apparatus 1 (developing device 324) from the ordinary developing mode to the toner removing mode (in Step S4).

When the toner removing mode is set, the bias voltage control unit 94 sets the bias voltages in the toner removing mode as described above (in Step S5). Subsequently, the image forming control unit 92 starts to control the photosensitive drum 321, the magnetic roller 82, and the developing roller 83 for aging drive, with application of the bias voltages in the toner removing mode (in Step S6). By performing the above operation, a polishing operation of the circumferential surface 83A by a magnetic brush with use of the additive E as a polishing agent is started. The control unit 90 starts a timer along with start of aging drive.

Thereafter, the control unit 90 checks whether a predetermined time (e.g. 60 seconds) has elapsed from start of aging drive (in Step S7). In the case where a predetermined time has not elapsed (NO in Step S7), the aging drive is continued. In the case where a predetermined time has elapsed (YES in Step S7), the resistance value evaluating unit 93 acquires, from the detection unit D, a measurement value relating to the surface resistance value on the circumferential surface 83A at the above point of time (in Step S8). Further, the resistance value evaluating unit 93 determines whether the acquired measurement value is over the predetermined threshold value range (in Step S9).

In the case where the measurement value is out of the threshold value range (NO in Step S9), the toner layer TLa on the circumferential surface 83A has not been sufficiently removed. Accordingly, the control returns to Step S6, and the aging drive is continued. On the other hand, in the case where the measurement value lies within the threshold value range (YES in Step S9), the toner layer TLa has been sufficiently removed. Accordingly, the aging drive is stopped (in Step S10). Alternatively, Step S8 and Step S9 may be omitted, in other words, the control may proceed to Step S10, assuming that the toner layer TLa has been sufficiently removed by the aging drive for a predetermined time.

Thereafter, the mode setting unit 91 changes the operation mode from the toner removing mode to the ordinary developing mode (in Step S11). Subsequently, the control unit 90 returns to Step S1, and waits for arrival of a next sampling period. If there is a print job in a standby state until completion of the toner removing mode, the image forming control unit 92 immediately executes the print job.

In the following, practical examples of the embodiment, and a comparative example are described. The image forming apparatus used in the test is a color complex machine TASKalfa5550ci (product name of KYOCERA Document Solutions Inc.).

Example 1

An image forming process was performed with respect to sheets, with application of the following bias voltages in the ordinary developing mode. A flow-in current D2 between the developing roller 83 and the magnetic roller 82 was measured, each time an image forming process with respect to 1,000 sheets was performed. When the measured flow-in current D2 was not larger than 0.2 μA, it was concluded that toner in excess of a threshold value adhered to the circumferential surface 83A of the developing roller 83, and the aging drive for one minute was performed, with application of the following bias voltages in the toner removing mode. A durability test regarding an image forming process was carried out with respect to 100,000 sheets in the aforementioned control condition.

| (Bias Voltage Setting) | | |
|---|---|---|
| | [ordinary developing mode] | [toner removing mode] |
| MagVpp | 2.0 kV | 2.8 kV |
| MagDC | 250 V | 100 V |
| SlvDC | 50 V | 200 V |
| DrmDC | 20 V | 50 V |

Example 2

An image forming process was performed with respect to sheets, with application of the following bias voltages in the ordinary developing mode. A leak voltage D1 between the circumferential surface 321A of the photosensitive drum 321, and the circumferential surface 83A of the developing roller 83 was measured, each time an image forming process with respect to 1,000 sheets was performed. When the measured leak voltage D1 increased by 150V with respect to the leak voltage at the time of ordinary operation (a state that toner is not adhered to the circumferential surface 83A), it was concluded that toner in excess of a threshold value adhered to the circumferential surface 83A, and the aging drive for one minute was performed, with application of the following bias voltages in the toner removing mode. A durability test regarding an image forming process was carried out with respect to 100,000 sheets in the aforementioned control condition.

| (Bias Voltage Setting) | | |
|---|---|---|
| | [ordinary developing mode] | [toner removing mode] |
| MagVpp | 2.0 kV | 2.9 kV |
| MagDC | 250 V | 150 V |
| SlvDC | 50 V | 250 V |
| DrmDC | 20 V | 50 V |

Comparative Example

A durability test regarding an image forming process with respect to 100,000 sheets was carried out, with application of the same bias voltages in the ordinary developing mode as in Examples 1 and 2, except that measurement of the flow-in current D2 or the leak voltage D1 as conducted in Examples 1 and 2 was not performed, and that interrupt control in the toner removing mode was not performed.

Regarding Examples 1 and 2, and Comparative Example, at each timing corresponding to an initial period (number of processed sheets=0 sheet), and corresponding to the number of processed sheets=10K (10,000 sheets), 30K (30,000 sheets), 50K (50,000 sheets), 70K (70,000 sheets), and 100K (100,000 sheets), the degree of occurrence of "fog" on the sheets subjected to image formation, and "density" as an image density on the sheets were evaluated. Further, at each timing, the circumferential surface 83A of the developing roller 83 provided in the image forming unit 32C for cyan was visually observed, and the "degree of adhesion" of toner was evaluated. The color of the circumferential surface 83A is initially black. In the visual observation, when the color of the circumferential surface 83A was black or a color analogous to black, the degree of adhesion of toner was evaluated to be good. When the color of the circumferential surface 83A appeared to be cyan (blue), the degree of adhesion of toner was evaluated to be poor.

The aforementioned evaluation result is illustrated in FIG. 11. In Examples 1 and 2, substantial degradation regarding "FOG" and "DENSITY" did not occur after printing of 100,000 sheets. This is because, as illustrated in the evaluation column "DEGREE OF ADHESION", a toner non-adhesion state was maintained on the circumferential surface 83A of the developing roller 83 during the durability test, and a developing operation was performed in a satisfactory manner. On the other hand, in Comparative Example, the evaluation values regarding "FOG" and "DENSITY" were lowered after the number of processed sheets exceeded 50,000. This may be associated with the evaluation column "DEGREE OF ADHESION", in which the degree of adhesion was poor after the number of processed sheets exceeded 50,000.

As described above, according to the embodiment, the image forming apparatus 1 provided with the developing device 324 employing a touchdown developing method is capable of suppressing toner adhesion to the circumferential surface 83A of the developing roller 83, without affecting the toner performance. Thus, it is possible to provide the image forming apparatus 1 capable of maintaining image quality in a satisfactory manner.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image carrier including a circumferential surface configured to carry an electrostatic latent image and a toner image thereon;

a developer carrier including a circumferential surface configured to carry a developer layer containing toner, an additive, and carriers thereon;

a toner carrier including a circumferential surface configured to come into contact with the developer layer and to carry a toner layer by receiving toner from the developer layer so as to supply toner of the toner layer to the image carrier for developing the electrostatic latent image;

a bias voltage control unit configured to apply a separate bias voltage to each of the image carrier, the developer carrier, and the toner carrier, and to control the separate bias voltages; and a detection unit configured to electrically detect a fixed toner adhesion condition with respect to the circumferential surface of the toner carrier, the fixed toner adhesion condition being one in which a toner layer is adhered to the circumferential surface of the toner carrier; wherein the bias voltage control unit changes bias voltage setting from an ordinary developing mode to a toner removing mode when the detection unit detects toner adhesion in excess of a threshold value, and in the toner removing mode, the bias voltage control unit sets the separate bias voltage to be applied to the image carrier, the developer carrier, and the toner carrier in such a manner that only the additive remains on the circumferential surface of the toner carrier having the adhered toner layer, and the developer layer carried on the developer carrier comes into contact with the circumferential surface of the toner carrier with a large force, as compared with the ordinary developing mode.

2. The image forming apparatus according to claim 1, wherein the toner is charged with a first polarity, the additive and the carriers are charged with a second polarity opposite to the first polarity, and in the toner removing mode, the bias voltage control unit sets the separate bias voltages in such a manner that an electric potential of the toner carrier is set to be higher at the first polarity between the image carrier and the toner carrier, and between the developer carrier and the toner carrier to thereby allow only the additive to remain on the circumferential surface of the toner carrier.

3. The image forming apparatus according to claim 1, wherein the toner is charged with a first polarity, the additive and the carriers are charged with a second polarity opposite to the first polarity, the bias voltage control unit applies a separate DC bias voltage to each of the image carrier, the developer carrier, and the toner carrier, and applies an AC bias voltage after superimposition at least to the developer carrier, and in the toner removing mode, the bias voltage control unit is operative to:

set the separate DC bias voltages in such a manner that an electric potential of the toner carrier is set to be higher at the first polarity between the image carrier and the toner carrier, and between the developer carrier and the toner carrier to thereby allow only the additive to remain on the circumferential surface of the toner carrier, and set the AC bias voltage to be applied to the developer carrier to be higher than in the ordinary developing mode for electrically increasing a pressing force of the carriers with respect to the circumferential surface of the toner carrier to thereby increase contact of the developer layer with the circumferential surface of the toner carrier.

4. The image forming apparatus according to claim 1, wherein the detection unit is configured to obtain an evaluation value which changes based on a variation in electrical resistance value of the circumferential surface of the toner carrier.

5. The image forming apparatus according to claim 4, wherein the detection unit includes a mechanism configured to detect a voltage at which discharge is generated between the image carrier and the toner carrier.

6. The image forming apparatus according to claim 4, wherein the detection unit includes a mechanism configured to detect a current flowing between the toner carrier and the developer carrier.

* * * * *